US007810285B1

(12) United States Patent
Liptak

(10) Patent No.: US 7,810,285 B1
(45) Date of Patent: Oct. 12, 2010

(54) BUILDING BARRIER SYSTEM AND ASSOCIATED METHOD

(76) Inventor: Robert L. Liptak, 81 Breezy La., P.O. Box 333, Morrisdale, PA (US) 16858

( * ) Notice: Subject to any disclaimer, the term of this patent is extended or adjusted under 35 U.S.C. 154(b) by 285 days.

(21) Appl. No.: 11/851,027

(22) Filed: Sep. 6, 2007

Related U.S. Application Data

(60) Provisional application No. 60/825,780, filed on Sep. 15, 2006.

(51) Int. Cl.
*E04B 1/346* (2006.01)

(52) U.S. Cl. ..... 52/69; 52/173.2; 52/768; 52/772; 52/63; 52/64; 52/79.6; 52/71; 52/764; 52/73; 256/24; 256/26; 256/73; 404/6; 404/9; 49/397; 49/400

(58) Field of Classification Search ..... 52/173.2, 52/175, 768, 762, 770, 772, 63, 64, 69, 79.6, 52/235, 65, 71, 764, 73; 256/24, 26, 27, 256/28, 29, 30, 31, 73, 65.13; 14/69.5, 71.1, 14/71.3, 33, 50, 51, 68; 404/6, 9; 49/397, 49/400; 187/241, 244; 296/56, 180.1, 57.1
See application file for complete search history.

(56) References Cited

U.S. PATENT DOCUMENTS

| | | | | | |
|---|---|---|---|---|---|
| 2,821,431 | A | * | 1/1958 | Crompton | 296/57.1 |
| 3,171,223 | A | * | 3/1965 | Josephson | 40/530 |
| 3,734,239 | A | * | 5/1973 | Martin et al. | 187/243 |
| 3,805,816 | A | | 4/1974 | Nolte | |
| 3,892,387 | A | * | 7/1975 | Mann | 256/24 |
| 3,984,960 | A | | 10/1976 | Raio et al. | |
| 4,459,790 | A | * | 7/1984 | Vermillion | 52/764 |
| 4,529,351 | A | * | 7/1985 | Olins | 414/545 |
| 4,585,265 | A | * | 4/1986 | Mader | 296/56 |
| 4,691,484 | A | * | 9/1987 | Wilson | 52/79.6 |
| 4,691,956 | A | * | 9/1987 | Hodge | 296/51 |
| 4,961,297 | A | | 10/1990 | Bernard | |
| 5,248,215 | A | * | 9/1993 | Fladung | 404/6 |
| 5,314,167 | A | | 5/1994 | Holloman | |
| 5,364,076 | A | * | 11/1994 | Nicholls | 256/22 |
| 5,372,354 | A | * | 12/1994 | Cacicedo | 256/22 |
| 5,502,929 | A | * | 4/1996 | Daniels | 52/69 |
| 5,819,474 | A | | 10/1998 | Strom | |
| 5,920,936 | A | * | 7/1999 | Wiedeck et al. | 14/14 |
| 5,957,437 | A | * | 9/1999 | Savenok | 256/65.13 |
| 6,135,526 | A | * | 10/2000 | Reckner, Jr. | 296/37.13 |
| 6,141,927 | A | * | 11/2000 | Usui | 52/263 |
| 6,209,267 | B1 | * | 4/2001 | Dantzer | 52/79.6 |
| 6,491,287 | B1 | * | 12/2002 | Savenok | 256/59 |
| 6,793,263 | B1 | * | 9/2004 | Bruford et al. | 296/50 |
| 6,904,720 | B1 | | 6/2005 | Adolfson et al. | |
| 7,258,461 | B1 | * | 8/2007 | Izardel et al. | 362/152 |
| 7,461,489 | B2 | * | 12/2008 | Herbertsson | 52/578 |
| 2003/0190193 | A1 | * | 10/2003 | Waters, Jr. | 405/110 |

(Continued)

*Primary Examiner*—Robert J Canfield
*Assistant Examiner*—Matthew J Gitlin
(74) *Attorney, Agent, or Firm*—Eckert Seamans Cherin & Mellott, LLC; Arnold B. Silverman, Esq.

(57) ABSTRACT

A building barrier system wherein a portion of the building barrier system can transition between an erect position and a substantially flat position thereby allowing access to the interior of the structure without having to disassemble the building barrier system and associated method.

12 Claims, 16 Drawing Sheets

U.S. PATENT DOCUMENTS

2003/0213073 A1* 11/2003 Alexander ..... 14/71.1
2004/0025464 A1* 2/2004 Williams ..... 52/483.1
2004/0250506 A1 12/2004 Yokota
2007/0096492 A1* 5/2007 Austin ..... 296/50

* cited by examiner

BUILDING BARRIER SYSTEM AND ASSOCIATED METHOD

CROSS-REFERENCE TO RELATED APPLICATION

The present application claims the benefit of U.S. Provisional Application Ser. No. 60/825,780, filed Sep. 15, 2006, entitled "BUILDING BARRIER SYSTEM AND ASSOCIATED METHOD."

BACKGROUND OF THE INVENTION

1. Field of the Invention

This invention relates generally to a building barrier system, and associated method, for use with a structure that is under construction. More particularly, this invention relates to a building barrier system that can be transitioned between an erect position and a substantially flat position.

2. Description of the Related Art

During the construction of a structure (building) having multiple levels (floors), such as an office building, United States Government OSHA regulations require that some type of railing structure be erected around the perimeter of a floor when the floor is a certain height above the surrounding ground. Specifically. OSHA regulations require that the railing be able to withstand a "down and out" force of 200 pounds (lbs.) and have a height (H) of 42 inches (in.).

When such a railing structure is erected per OSHA regulations, however, access from the exterior of the structure to the interior of the structure (or vice versa) is prohibited. Accordingly, a portion of the railing structure is typically disassembled or removed when building materials are required to be imported onto the floor from the exterior of the structure. Once the building materials have been imported, however, construction crews often do not reassemble the railing structure because reassembly of the railing structure is not only inconvenient but is time consuming as well.

U.S. Pat. No. 6,904,720 discloses an enclosure system for partially enclosing a structure that is under construction. Specifically, this patent provides a construction enclosure system that comprises a plurality of frames, which are secured to the structure by brackets that are bolted to the structure's deck (floor), that are adapted to receive one or more enclosure panels used to partially enclose the structure. The enclosure panel can be moved from one deck of the structure to the next by sliding the panel along the frame members. However, similar to other railing structures, the enclosure system that is disclosed in this patent prevents building materials from being imported or exported from the structure when it is properly being used.

Therefore, there exists a need for a building barrier system that can allow building materials to be imported onto or exported from a floor without having to disassemble the building barrier system.

SUMMARY OF THE INVENTION

This invention meets this as well as other needs by disclosing a building barrier system that can transition between an erect position and a substantially flat position thereby allowing access to the interior of the structure without having to disassemble the building barrier system. Moreover, this invention discloses a method for installing such a building barrier system.

In accordance with one embodiment of the invention, a building barrier system comprising: a deck; a first support post having a first side, a second side, a first aperture, and a second aperture; a second support post having a first side, a second side, a first aperture, and a second aperture; a third support post having a first side, a second side, a first aperture, and a second aperture; each of said first, second, and third support posts secured to said deck and extending in a direction substantially perpendicular to said deck, said first support post being substantially parallel and spaced from said second support post and said second support post being substantially parallel and spaced from said third support post; a fixed panel having a first edge and a second edge, said first edge of said fixed panel positioned adjacent to said second side of said first support post and said second edge of said fixed panel positioned adjacent to said first side of said second support post, said fixed panel being secured to each of said first and second support post; a movable panel having a first edge and a second edge, said first edge of said movable panel positioned adjacent to said second side of said second support post and said second edge of said movable panel positioned adjacent to said first side of said third support post, said movable panel in a first position being removably secured to said second and third support posts, and in a second position being pivotable toward said deck; and a first shaft extending from said first and second edges of said movable panel, said first shaft being received into said first passageway disposed in each of said second and third support posts.

In accordance with another embodiment of the invention, a method for erecting a building barrier system on a deck of a structure comprising: providing a first support post having a first side, a second side, a first aperture, and a second aperture; providing a second support post having a first side, a second side, a first aperture, and a second aperture; providing a third support post having a first side, a second side, a first aperture, and a second aperture; securing each of said first, second, and third support posts to said deck in a direction substantially perpendicular to said deck, said first support post being substantially parallel and spaced from said second support post and said second support post being substantially parallel and spaced from said third support post; providing a fixed panel having a first edge and a second edge; positioning said first edge of said fixed panel adjacent to said second side of said first support post and said second edge of said fixed panel adjacent to said first side of said second support post; securing said fixed panel to each of said first and second support posts; providing a movable panel having a first edge and a second edge; positioning said first edge of said movable panel adjacent to said second side of said second support post and said second edge of said movable panel adjacent to said first side of said third support post; securing in a first position said movable panel to each of said second and third support posts; providing a first shaft, said first shaft extending from said first and second edges of said movable panel thereby allowing said movable panel to transition into a second position, wherein said movable panel in said second position being pivotable towards said deck.

In accordance with another embodiment of the invention, a building structure comprising: a deck; a building barrier system secured to said deck, said building barrier system including: a first support post having a first side, a second side, a first aperture, and a second aperture; a second support post having a first side, a second side, a first aperture, and a second aperture; a third support post having a first side, a second side, a first aperture, and a second aperture; each of said first, second, and third support posts secured to said deck and extending in a direction substantially perpendicular to said deck, said first support post being substantially parallel and spaced from said second support post and said second support post being substantially parallel and spaced from said third support post; a fixed panel having a first edge and a second edge, said first edge of said fixed panel positioned adjacent to said second side of said first support post and said second edge of said fixed panel positioned adjacent to said first side of said second support post, said fixed panel being secured to each of said first and second support post; a movable panel having a first edge and a second edge, said first edge of said movable panel positioned adjacent to said second side of said second support post and said second edge of said movable panel positioned adjacent to said first side of said third support post, said movable panel in a first position being removably secured to said second and third support posts, and in a second position being pivotable toward said deck; and a first shaft extending from said first and second edges of said movable panel, said first shaft being received into said first passageway disposed in each of said second and third support posts.

One object of the invention is to provide a building barrier system that allows access to the interior of a structure from the exterior of the structure (or vice versa) without having to be disassembled or removed.

Another object of the invention is to provide a reusable building barrier system.

Another object of this invention is to provide a building barrier system that can provide a degree of safety to individuals working on or visiting a structure that is under construction.

Another object of the invention is to provide a building barrier system that can provide the interior of a structure, which is being constructed, some degree of protection from weather elements, such as resisting rain and snow.

Another object of this invention is to maintain the heat within the interior of the structure when the building barrier system is in an erect condition.

Another object of this invention is to provide a method for installing such a building barrier system.

BRIEF DESCRIPTION OF THE DRAWINGS

A full understanding of the disclosed and claimed concept can be gained from the following Description when read in conjunction with the accompanying drawings in which:

DESCRIPTION OF THE PREFERRED EMBODIMENTS

Figure 1:
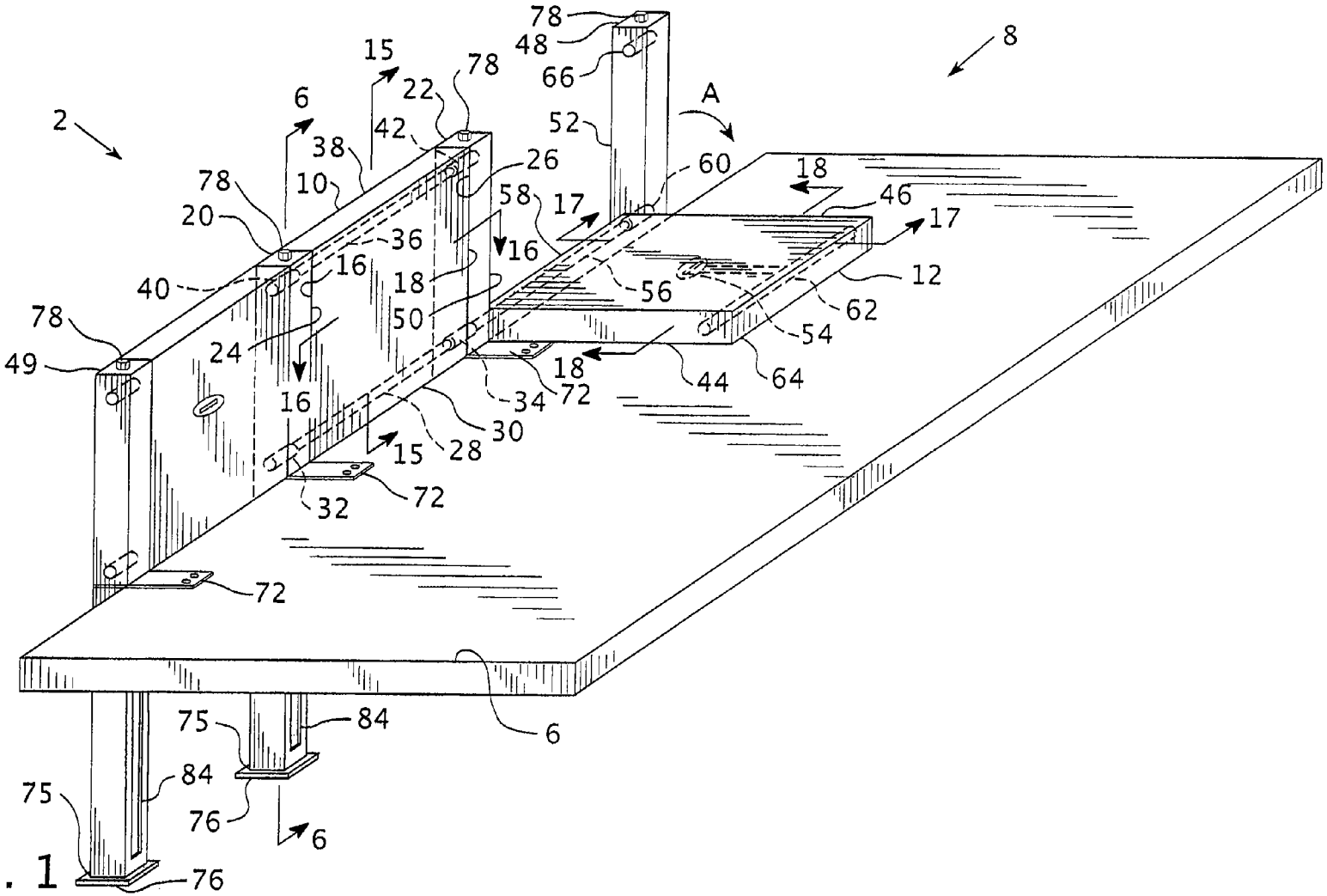
FIG. 1 is an isometric schematic view of one embodiment of the building barrier system.
Figure 2:
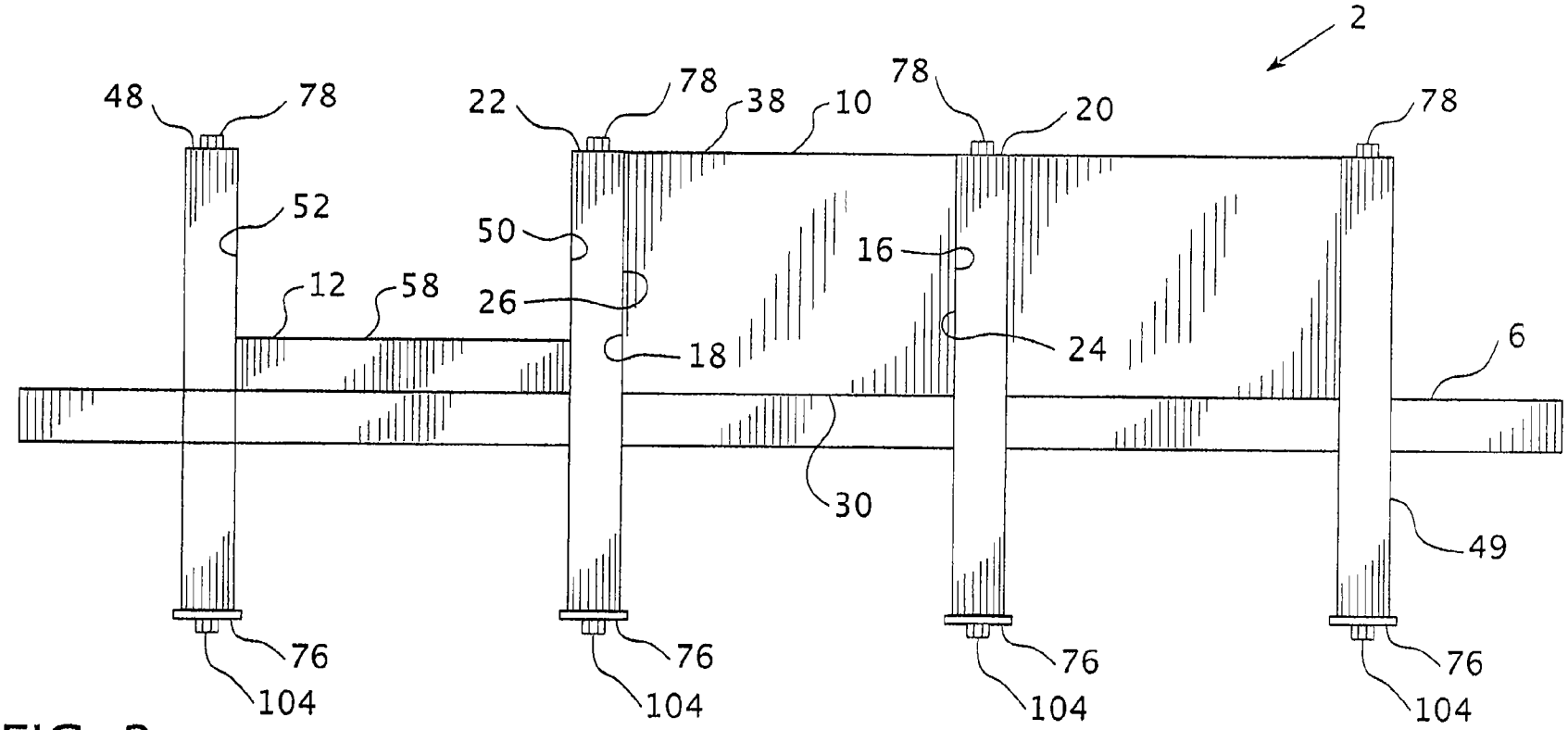
FIG. 2 is a schematic front elevational view of the building barrier system of FIG. 1.
Figure 3:
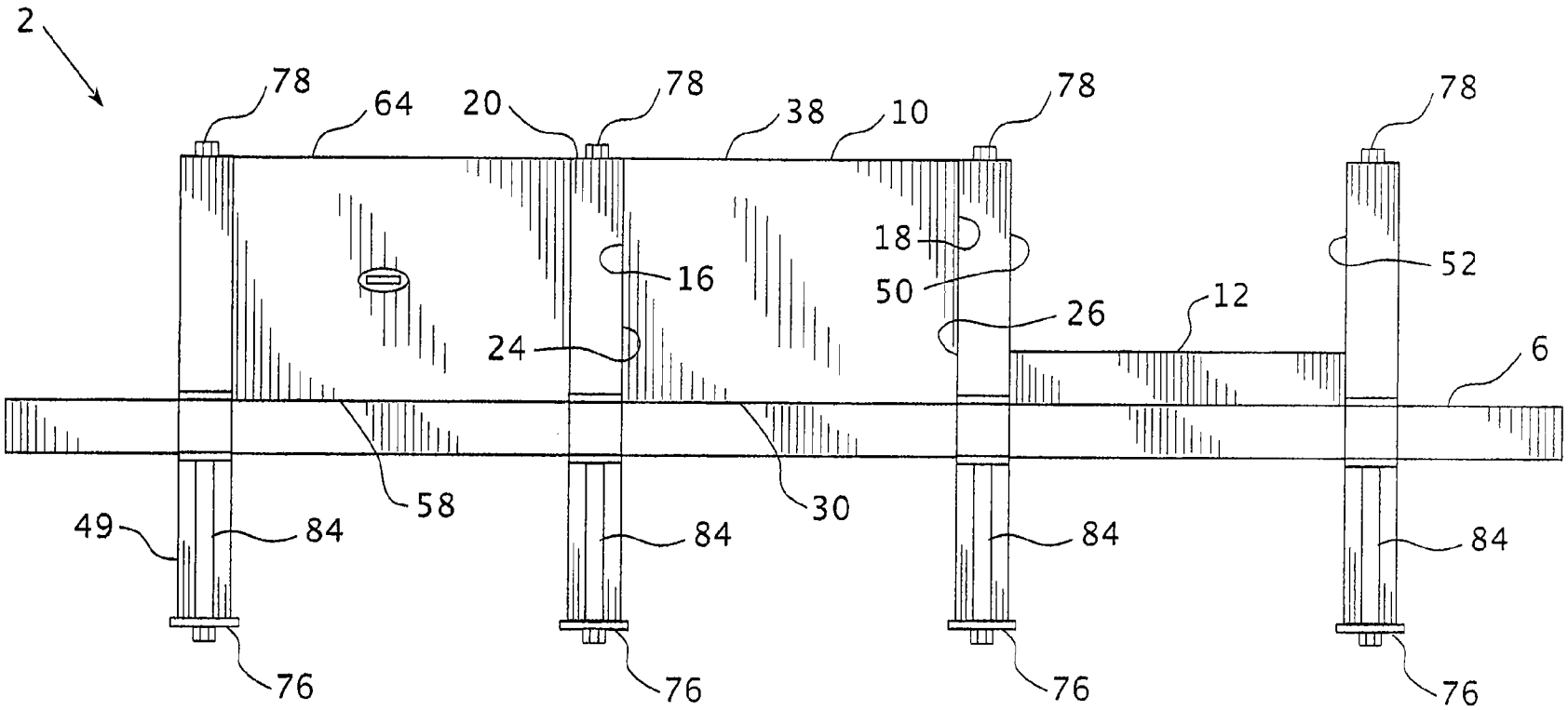
FIG. 3 is a rear elevational view of the building barrier system of FIG. 1.
Figure 4:
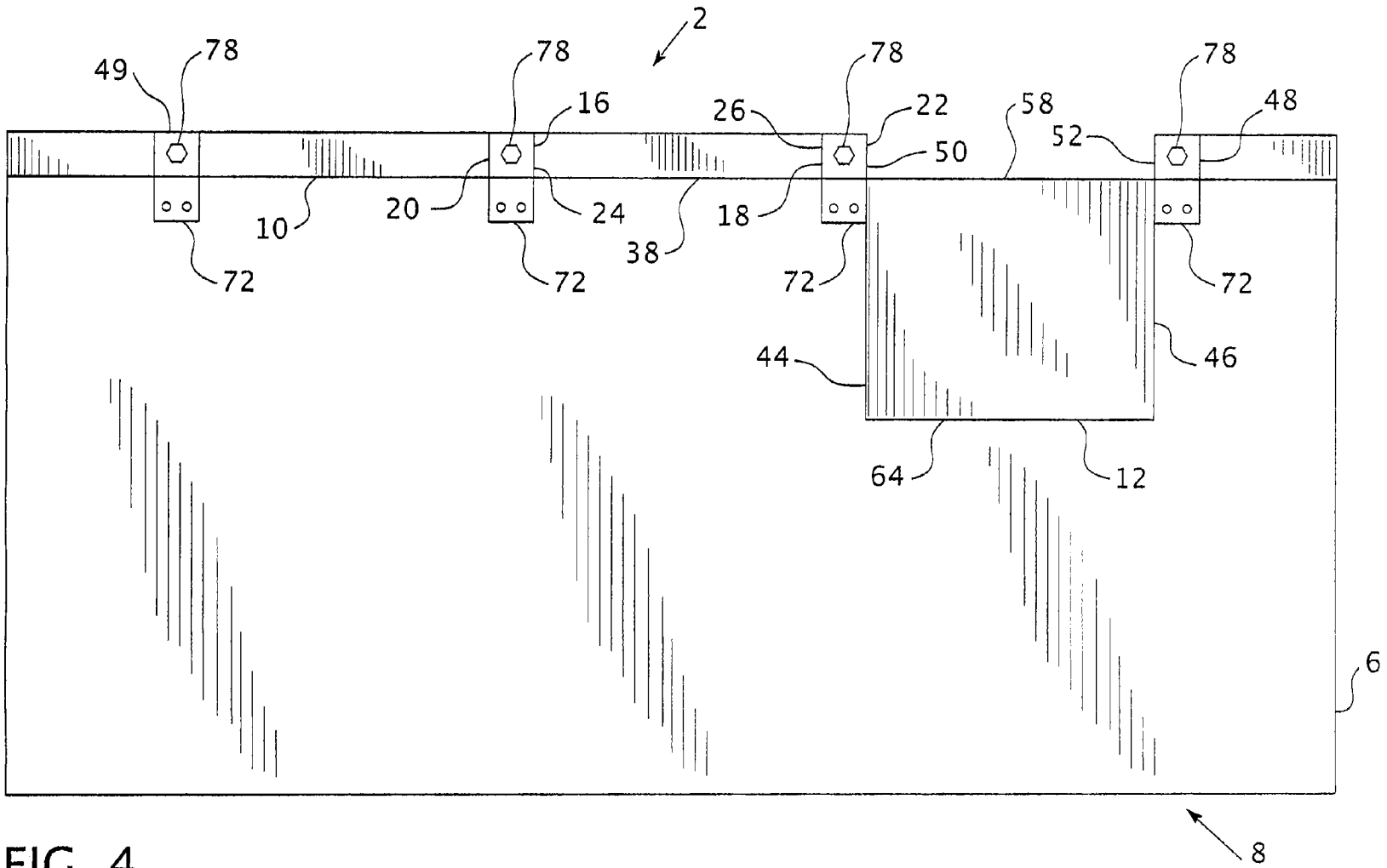
FIG. 4 is a top plan view of the building barrier system of FIG. 1.
Figure 5:
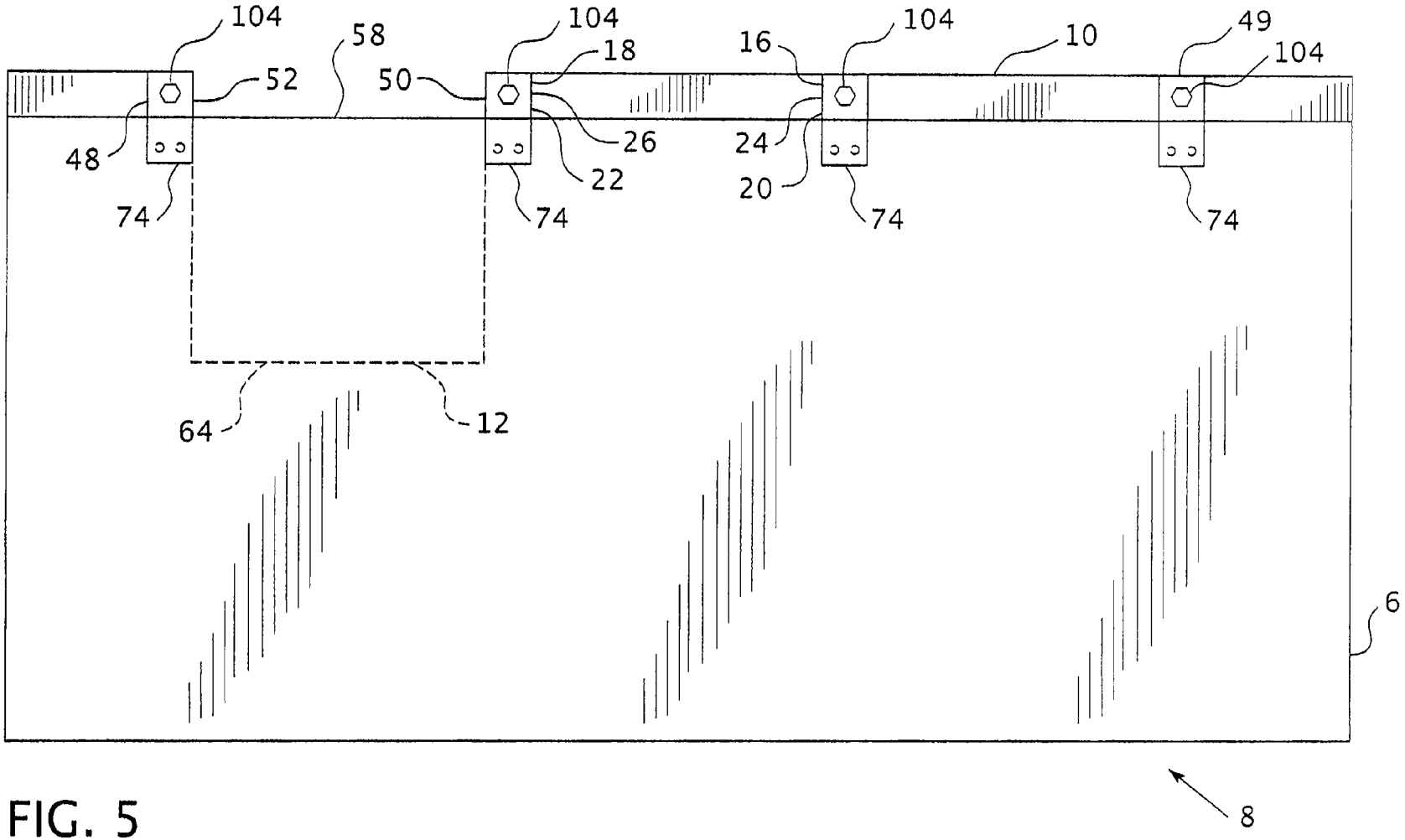
FIG. 5 is a bottom plan view of the building barrier system of FIG. 1.

As employed herein, the term "mechanical fastener" or variations thereof shall refer to any suitable fastening, connecting or tightening mechanism including, but not limited to, Velcro, tabs, snaps, screws, bolts, nuts, and the combination of bolts and nuts or bolts/nuts and washers.

When referring to any numerical range of values, such ranges are understood to include each and every number and/or fraction between the stated range minimum and maximum.

Directional phrases used herein, such as, for example, upper, lower, left, right, vertical, horizontal, top, bottom, above, beneath, clockwise, counterclockwise and derivatives thereof, relate to the orientation of the elements shown in the drawings and are not limiting upon the claims unless expressly recited therein.

Unlike other types and styles of enclosure/railing structures that are used during the construction of a multi-level structure, the building barrier system that is disclosed in this invention allows access from the exterior of the structure into the interior of the structure without having to remove or disassemble the building barrier system.

Referring to FIGS. 1-7, depict a building barrier system 2 in accordance with one embodiment of the invention. The building barrier system 2 includes a plurality of support posts (first support post 20, second support post 22, third support post 678, and fourth support post 679) that are secured to a deck 6 of a structure 8 that is being constructed as well as a fixed panel 10 and a movable panel 12.

The fixed panel 10, which has a first edge 16 and a second edge 18, is positioned between a first support post 20 and a second support post 22. Specifically, the first edge 16 of the fixed panel 10 is positioned adjacent to the second side 24 of the first support post 20 while the second edge 18 of the fixed panel 10 is positioned adjacent to the first side 26 of the second support post 22. The fixed panel 10 is secured to the first and second support posts 20,22 by a second shaft 28. The second shaft 28 extends from the first and second sides 16,18 of the fixed panel 10 substantially adjacent and co-planar to the first end 30 of the fixed panel 10. One end of the second shaft 28 is received into a first passageway 32 that is disposed in the first support post 20 while the other end of the second shaft 22 is received into a first passageway 34 that is disposed in the second support post 22. The fixed panel 10 is also secured to the first and second support posts 20,22 by a third shaft 36. The third shaft 36 extends from the first and second sides 16,18 of the fixed panel 10 substantially adjacent and co-planar to the second end 38 of the fixed panel 10. One end of the third shaft 36 is received into a second passageway 40 that is disposed in the first support post 20 while the other end of the third shaft 36 is received into a second passageway 42 that is disposed in the second support post 22. The fixed panel 10 can be manufactured from material that include, without limitation, plastic and fiberglass.

The movable panel 12, which has a first edge 44 and a second edge 46, is positioned between the second support post 22 and a third support post 678. When the movable panel 12 is an erect condition, the first edge 44 of the movable panel 12 is positioned adjacent to the second side 50 of the second support post 22 while the second edge 46 of the movable panel 12 is positioned adjacent to the first side 52 of the third support post 674. The movable panel 12 has a handle 54 for unlocking the movable panel 12 from the second and third support posts 22,48. A first shaft 56, which allows the movable panel 12 to pivot towards the deck 8, extends from the first and second sides 44,46 of the movable panel 12 substantially adjacent and co-planar to the first end 58 of the movable panel 12. One end of the first shaft 56 is received into the first passageway 34 that is disposed in the second support post 18 while the other end of the first shaft 56 is received into the first passageway 60 that is disposed in the third support post 678. A retractable shaft 62 extends from the first and second sides 44,46 of the movable panel 12 substantially adjacent and co-planar to the second end 64 of the movable panel 12. When the movable panel 12 is in an erect condition, one end of the retractable shaft 62 is received into the second passageway 42 that is disposed in the second support post 22 while the other end of the retractable shaft 62 is received into a second passageway 66 that is disposed in the third support post 678. In this particular embodiment, rotation of the handle 54 causes the ends of the retractable shaft 44 to retract, thereby unlocking the movable panel 12 from the second and third support posts 22,48. It should be noted, however, that despite FIG. 1 showing a handle 54 as the mechanism for unlocking the movable panel 12 from the second and third support posts 22,48, other mechanisms for unlocking the movable panel 12 from the second and third support posts 22,48 could include, without limitation, a button that can be actuated or a moveable slider.

Once the moveable panel 12 has been unlocked from the each of the second and third support posts 22,48, the moveable panel 12 is able to pivot towards the deck 6 in the direction of arrow A which allows access from the exterior of the structure 8 to the interior of the structure 8 (or vice versa) between the second and third support posts 22,48. In other words, the moveable panel 12 can be lowered onto the deck 6 so that building materials and/or other supplies can be imported onto or exported from the deck 6 of the structure. After the materials have been imported or exported, the moveable panel 12 can be raised in the direction opposite to arrow A and the handle 18 rotated, thereby extending the retractable shaft 62 and locking the movable panel 12 to the second and third support posts 22,48.

Figure 8:
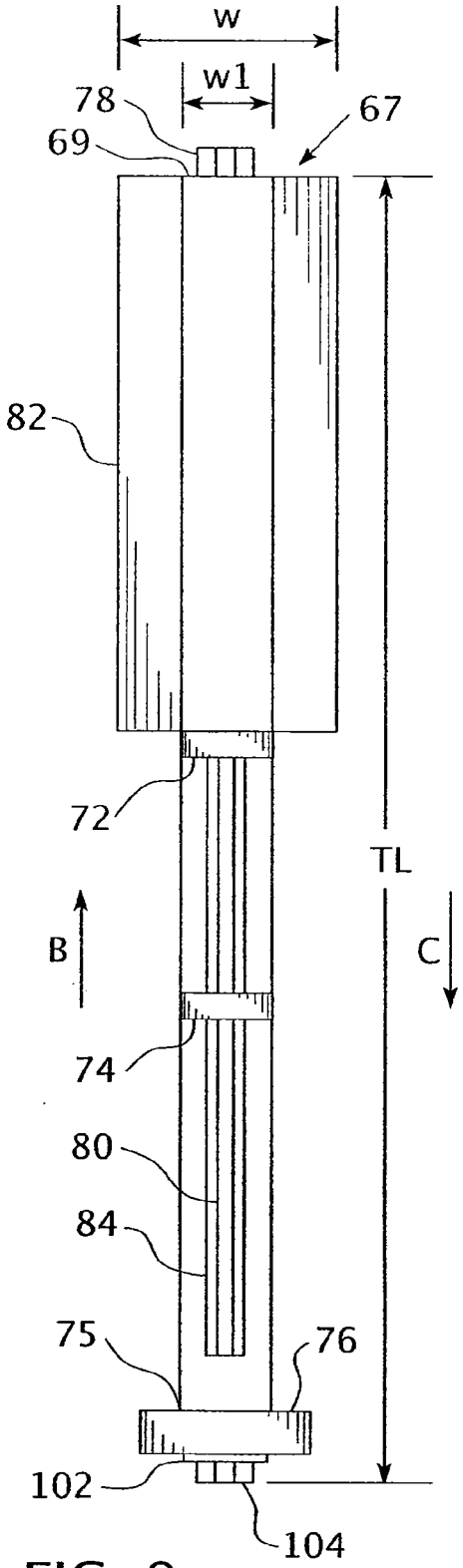
FIG. 8 is a rear elevational view of an embodiment of a support post.
Figure 9:
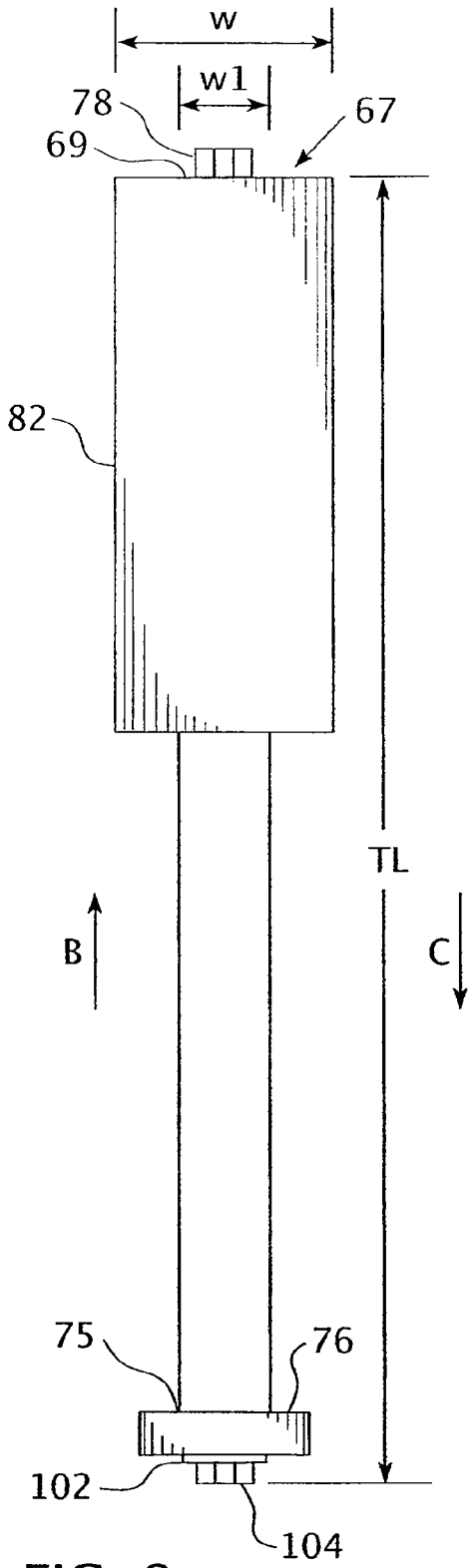
FIG. 9 is a front elevational view of the support post of FIG. 8.

Hereinafter, the first, second, and third support posts 20,22, 48 shall collectively be referred to as the support post 67. Referring to FIGS. 6-14*a*, the support post 67, which can be manufactured from a metal or a metal alloy, includes a housing 68 having a first end 69, a threaded channel 70, a first positioning plate 72, a movable second positioning plate 74, a second end, 75, an end plate 76, and a threaded rod 80. The threaded rod 80, which extends through the threaded channel 70 in a direction substantially parallel to an axis of the support post 67, can be rotated by rotation of a nut/bolt 78 that is disposed on the threaded rod 80. Located on one surface of the housing 68 is a protective plate 82 that is fastened to the housing 68 using techniques that are known in the art such as, without limitation, mechanical fasteners and/or welds. It is noted that the width (W) of the protective plate 82 can either be substantially equal to the width (W1) of the housing 68 or the width (W) of the protective plate 82 can be wider than the width (W1) of the housing 68 (FIGS. 8-9). Preferably, the protective plate 82 is fastened to the surface of the housing 4 that is facing the exterior of the structure 8 and is manufactured from aluminum or an aluminum alloy. Referring to FIG. 8, the housing 30 of the support post 67 also includes an elongated aperture 84, which extends substantially parallel to an axis of the support post 67, disposed on the surface of the housing 4 that faces the interior of the structure 8. As will be discussed in greater detail below, a portion of the movable second positioning plate 74 is positioned within the elongated aperture 84 which allows the second positioning plate 74 to move in the direction of arrow B when the threaded rod 80 is rotated. In one embodiment of the invention, the housing 30 of the support posts 4 can include one or more gripping handles (not shown), which are disposed on the surface of the housing 30 facing the interior of the structure 8, in order to aid in the installation of the support posts 4.

Continuing with FIGS. 8 and 9, the threaded rod 80 also extends through an aperture in the end plate 76. The end plate 76 is retained on the threaded rod 80 by a washer 102 and a mechanical fastener 104 which are positioned adjacent a side of the end plate 76. In accordance with one embodiment of the invention, the support post 67 has a total length (TL) of about 96 inches.

Figure 10:
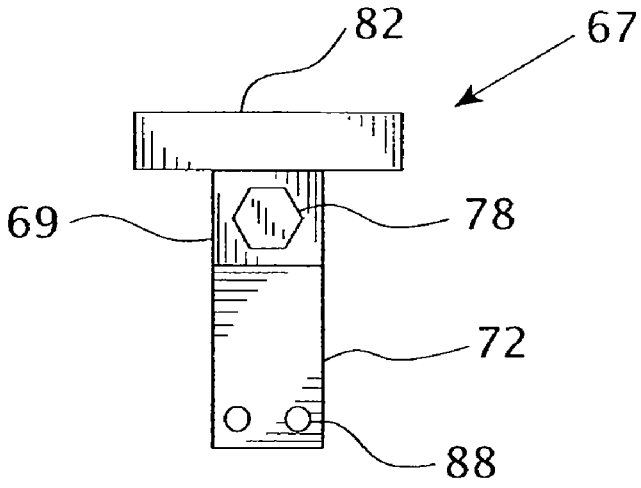
FIGS. 10 and 10*a* are top plan view of two embodiments of the support post.
Figure 10A:
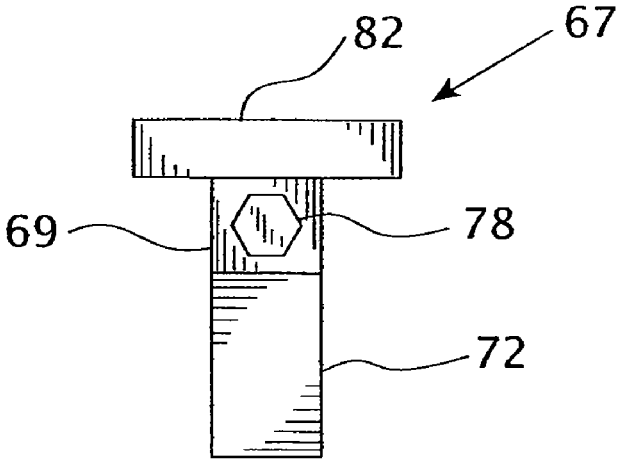
Figure 11:
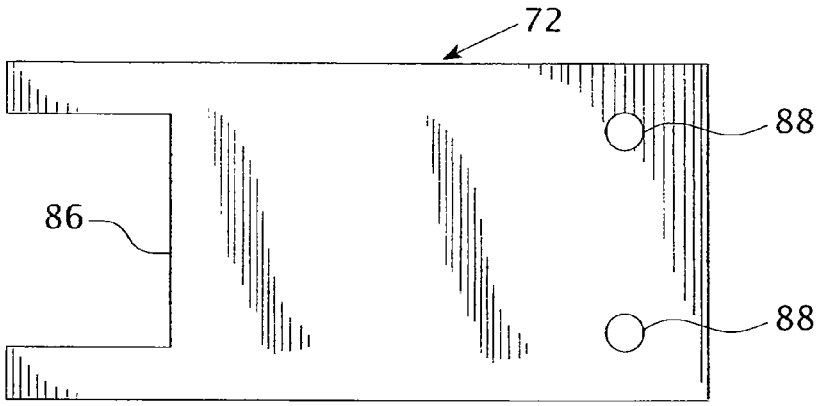
FIG. 11 is a top plan view of the first positioning plate.
Figure 12:
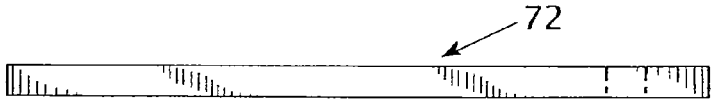
FIGS. 12 and 12A are left and right side elevational views of the first positioning plate of FIG. 11.
Figure 12A:
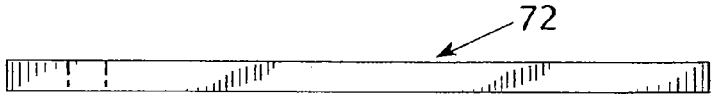

Referring to FIGS. 10-12*a*, the first positioning plate 72 has a substantially rectangular shape. Disposed on one end of the first positioning plate 72 is a recess 86 that is adapted to receive the housing 68. A surface of the first positioning plate 72 is secured to the housing 30 using techniques that are known in the art such as, without limitation, mechanical fasteners and/or welds. In the embodiment depicted in FIGS. 6-7, the first positioning plate 72 is fastened to the housing 30 of each of the support posts 4 by one or more welds. The first positioning plate 34 can also include one or more apertures 88 (FIGS. 10 and 11) that are structured to receive a mechanical fastener (not shown) that is fastened to the deck 6 of the structure 8, thereby providing additional means for securing each support post 67 to the structure 8. In other embodiments, however, the first positioning plate 72 can lack the apertures 88 (FIG. 10A).

Figure 6:
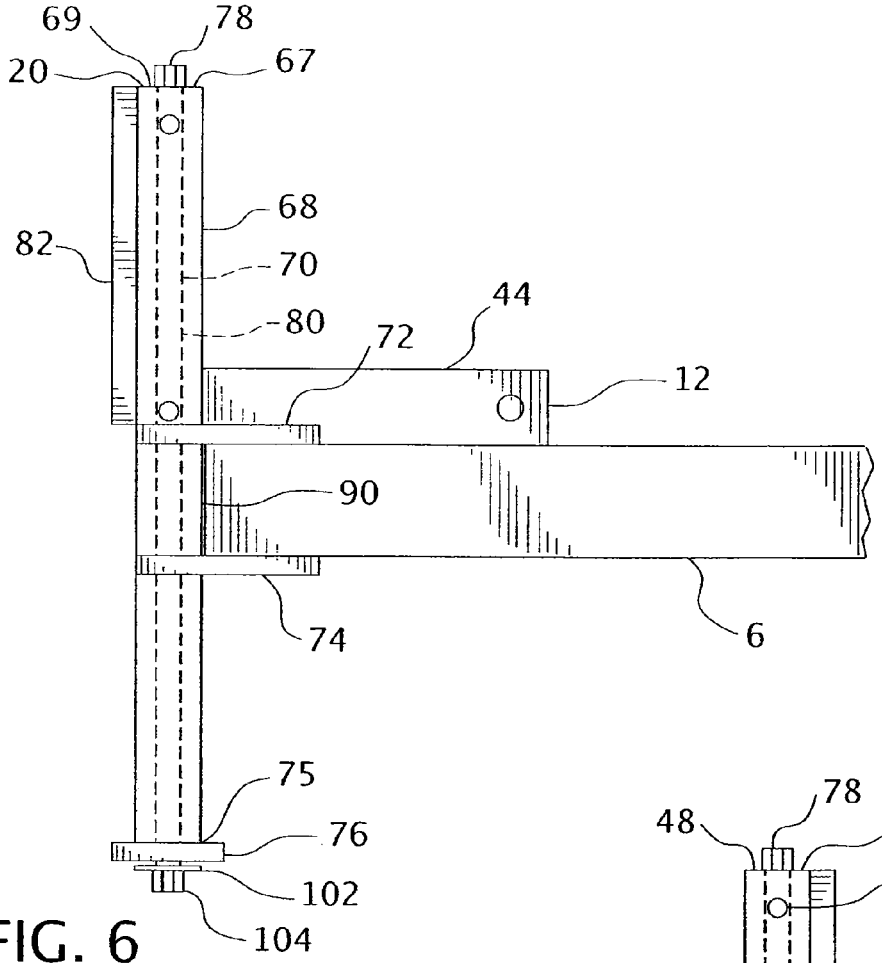
FIG. 6 is a left side elevational view of the building barrier system of FIG. 1 along 6-6.
Figure 7:
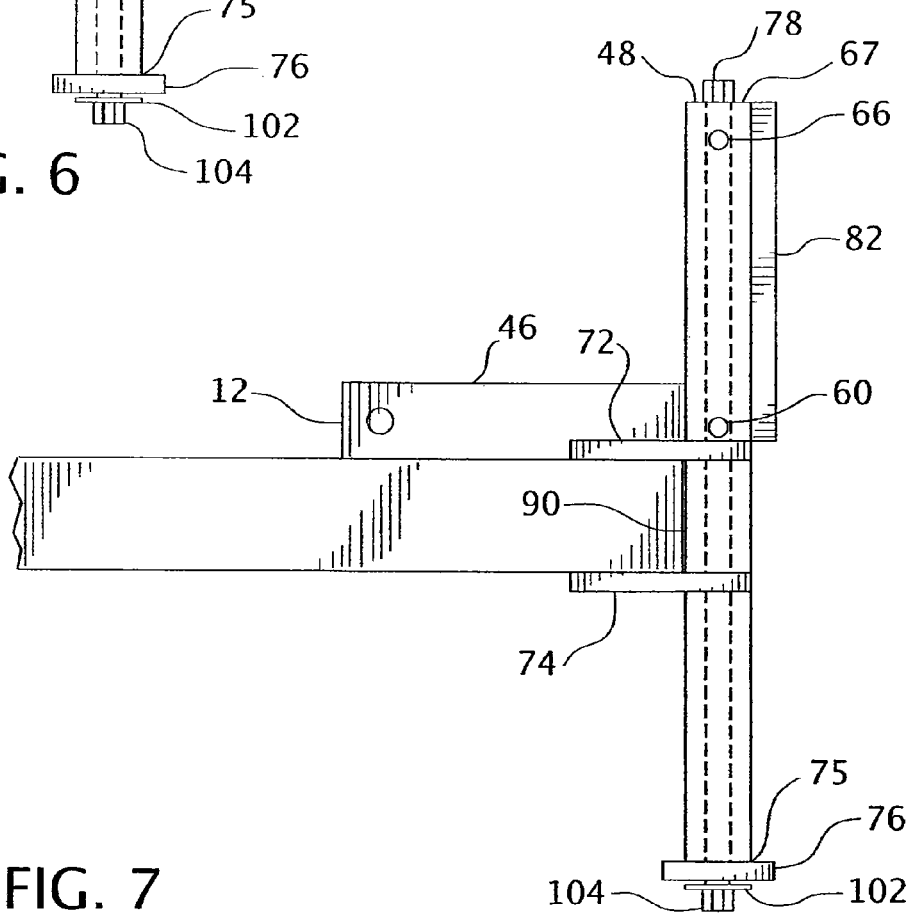
FIG. 7 is a right side elevational view of the building barrier system of FIG.
Figure 13:
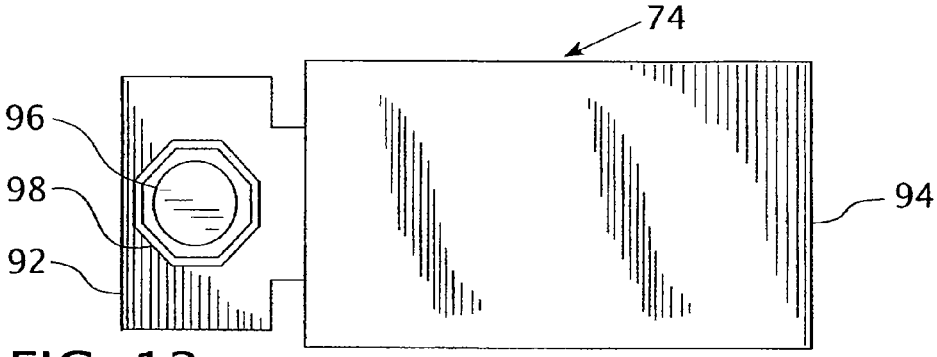
FIG. 13 is a top plan view of the second positioning.
Figure 14:
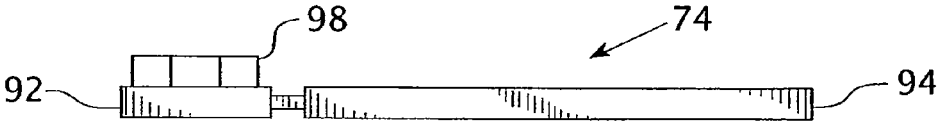
FIGS. 14 and 14A are left and right side elevational views of the second positioning plate of FIG. 13.
Figure 14A:
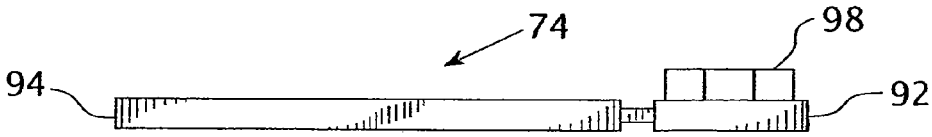

Referring to FIGS. 13-14*a*, the movable second positioning plate 74 is positioned adjacent to and below the first positioning plate 72, thereby forming a cavity 90 that receives the deck 6 of the structure 8 (FIGS. 6 and 7). Hereinafter, the first positioning plate 34 and the movable second positioning plate 36 shall collectively be referred to as positioning plates. The movable second positioning plate 74 is comprised of a first portion 92 and a second portion 94. The first portion 92 of the movable second positioning plate 74 is positioned within the elongated aperture 84 of the support post's 4 housing 68.

The second portion 94 of the movable second positioning plate 74 is positioned outside of the elongated aperture 84 and is the portion of the movable second positioning plate 74 that, in combination with the first positioning plate 72, defines the cavity 90. The first portion 92 of the movable second positioning plate 74 also includes an aperture 96 and a threaded bolt/nut 98 through which the threaded rod 80 extends. As can be seen from these figures, the threaded bolt/nut 98 is positioned substantially adjacent to the aperture 96. Upon rotation of the threaded rod 80 via the bolt/nut 78, the movable second positioning plate 74 can either travel up or down (arrows B and C in FIGS. 8 and 9) the threaded rod 80. Accordingly, the movable second positioning plate 74 is used to secure the support post 67 to the deck 6, which is received into the cavity 90 that is defined by the positioning plates 72,74, by clamping or sandwiching the deck 6 between the positioning plates 72,74.

The support post 67 is secured to the deck of a structure 8 by first inserting the deck 6 into the cavity 90 that is defined by the first positioning plate 72 and the movable second positioning plate 74. Once the deck 6 is received within the cavity 90, the bolt/nut 78, which is located substantially adjacent to the first end 69 of the housing 68, is rotated in order to move the movable second positioning plate 74 upwards towards the deck 6 in the direction of arrow B. The bolt 78 is rotated until the movable second positioning plate 74 comes into contact with a surface of the deck 6 thereby securing (i.e. clamping or sandwiching) the deck 6 between the positioning plates 72,74.

Figure 15:
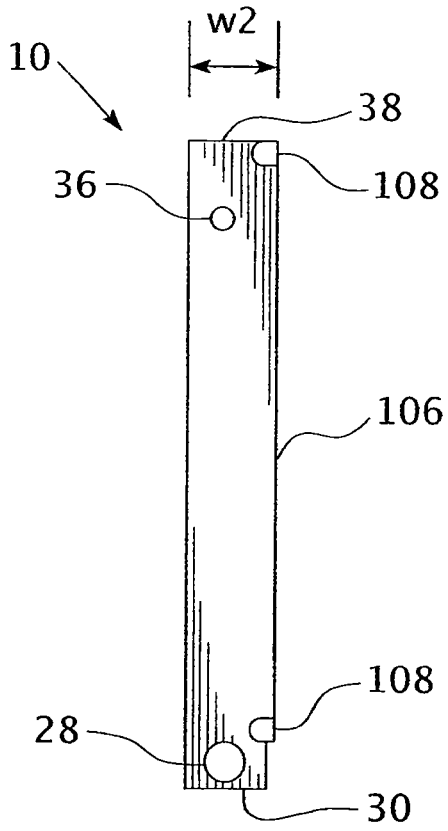
FIG. 15 is a cross-sectional view of a fixed panel of the building barrier system of FIG. 1 along 15-15.
Figure 15A:
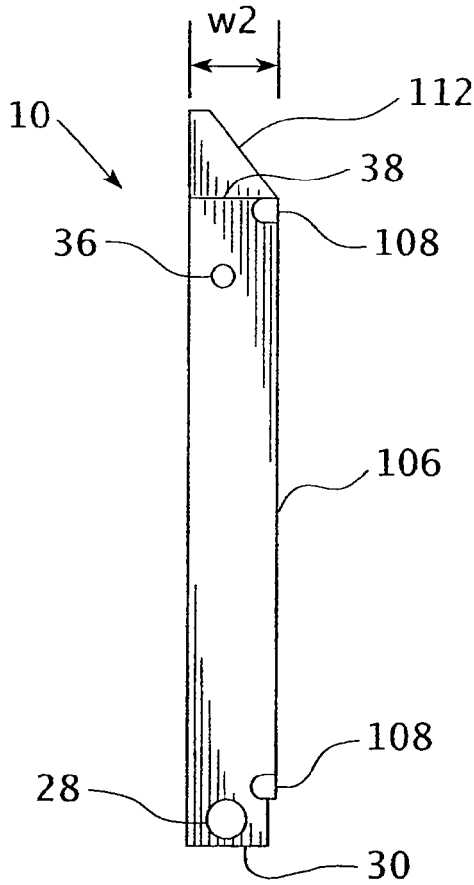
FIG. 15*a* is a cross-sectional view of an embodiment of the fixed panel of FIG. 15.
Figure 16:
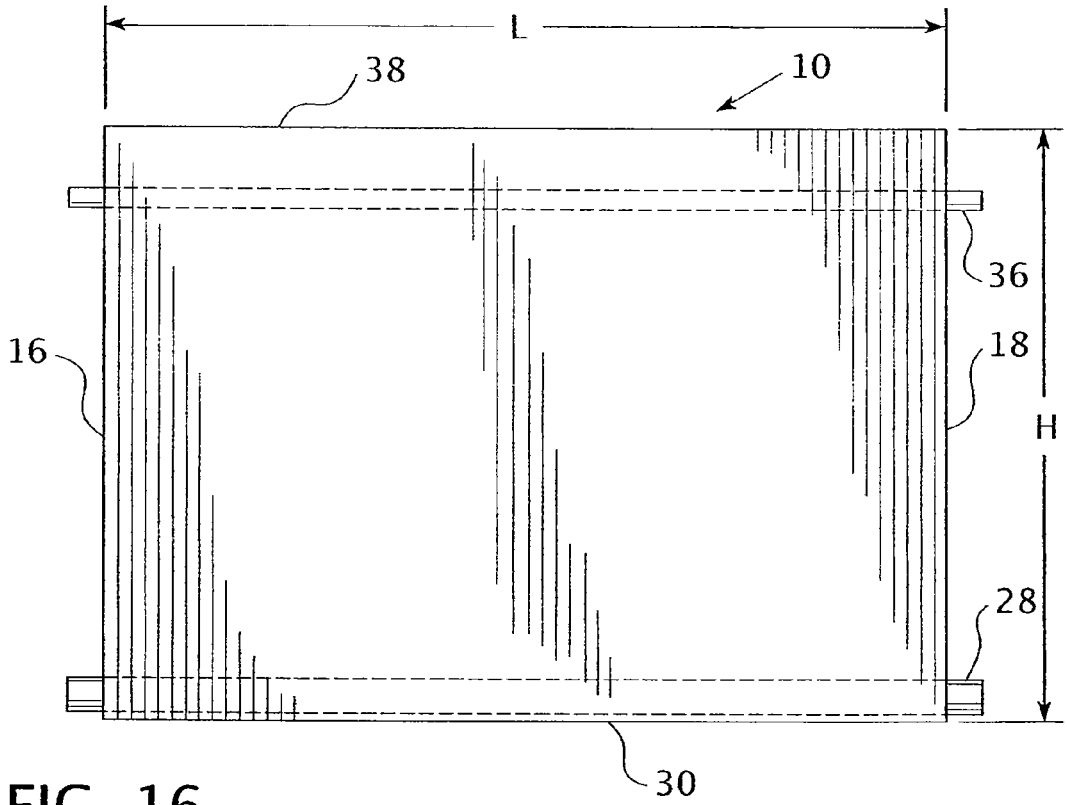
FIG. 16 is a rear elevational view of the fixed panel of the building barrier system of FIG. 1 along 16-16.
Figure 16A:
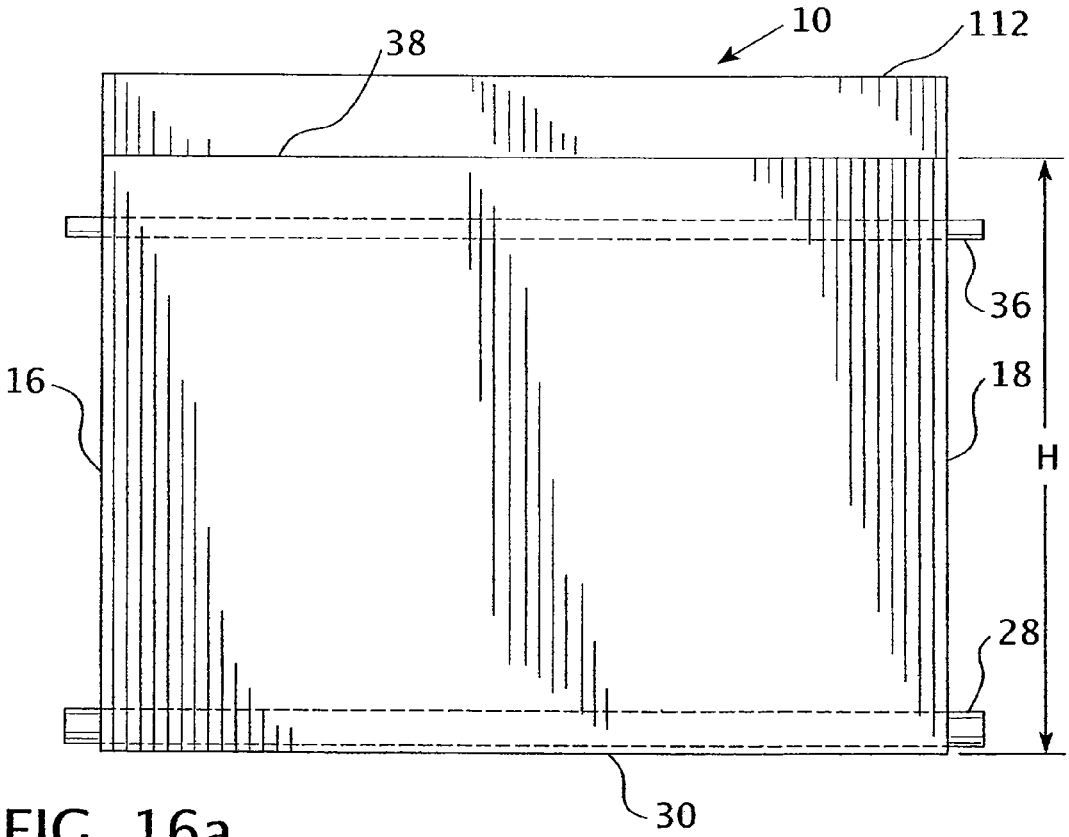
FIG. 16*a* is a rear elevational view of an embodiment of the fixed panel of FIG. 16.

Referring to FIGS. 15-16*a*, the fixed panel 10 is substantially rectangular in shape and, as stated above, has a first edge 16, a second edge 18, a first end 30, and a second end 38. A second shaft 28, which is located substantially adjacent to the first end 30 of the fixed panel 10, secures the fixed panel to the adjacent support posts 4 (i.e., first and second and support posts 20,22). A third shaft 36, which is positioned substantially adjacent to the second end 38, also secures the fixed panel to the adjacent support posts 4. Disposed on the exterior surface 106 of the fixed panel 10 are one or more apertures 108 positioned substantially adjacent to the first and second ends 30,38 of the fixed panel 10. In other embodiments of the fixed panel 10, the apertures are also located substantially adjacent to the first and second sides 16,18 as well. As will be discussed in greater detail below, the apertures 108 are structured to receive tabular members that extend from a surface of a connecting panel 110, thereby securing the connecting panel 110 to the fixed panel 10. In accordance with one embodiment of the invention, the fixed panel 10 can have a ramp 112 that is connected to the second end 38 of the fixed panel 10 (FIGS. 15*a* and 16*a*). In accordance with another embodiment of the invention, the fixed panel 10 has a total height (H) of about 42 inches (in.), a width (W2) of about 2 inches (in.), and a length (L) ranging from about 4 feet (ft.) to about 10 feet (ft.).

Figure 17:
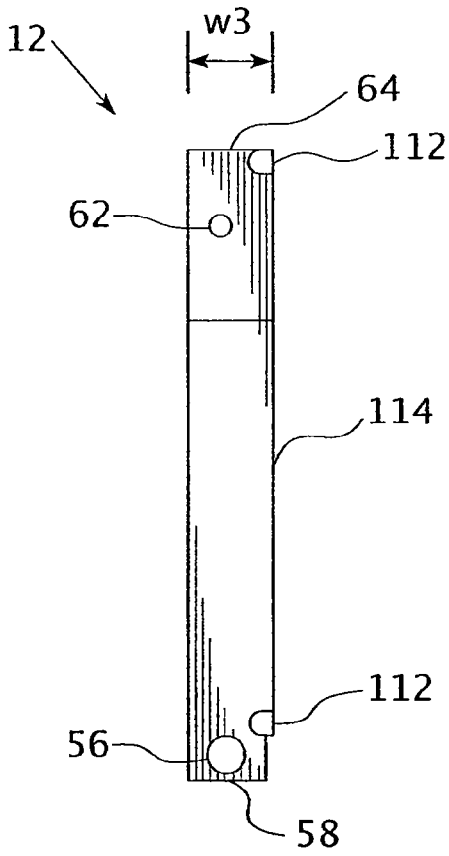
FIG. 17 is a cross-sectional view of a movable panel of the building barrier system of FIG. 1 along 17-17.
Figure 17A:
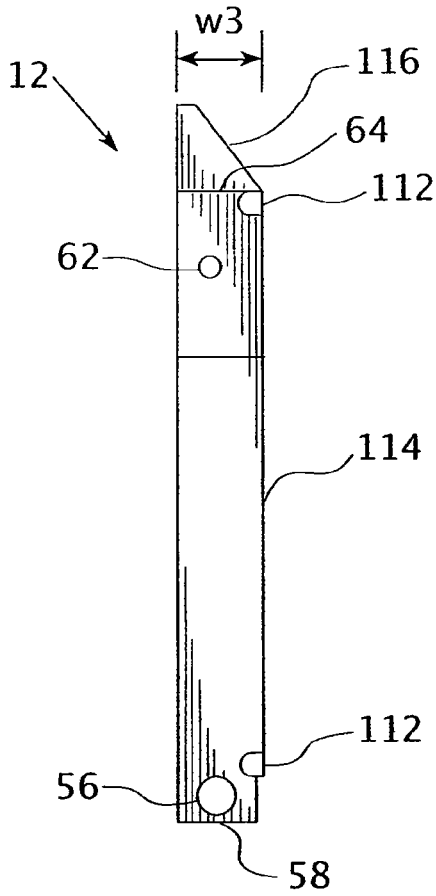
FIG. 17*a* is a cross-sectional view of an embodiment of the movable panel of FIG. 17.
Figure 18:
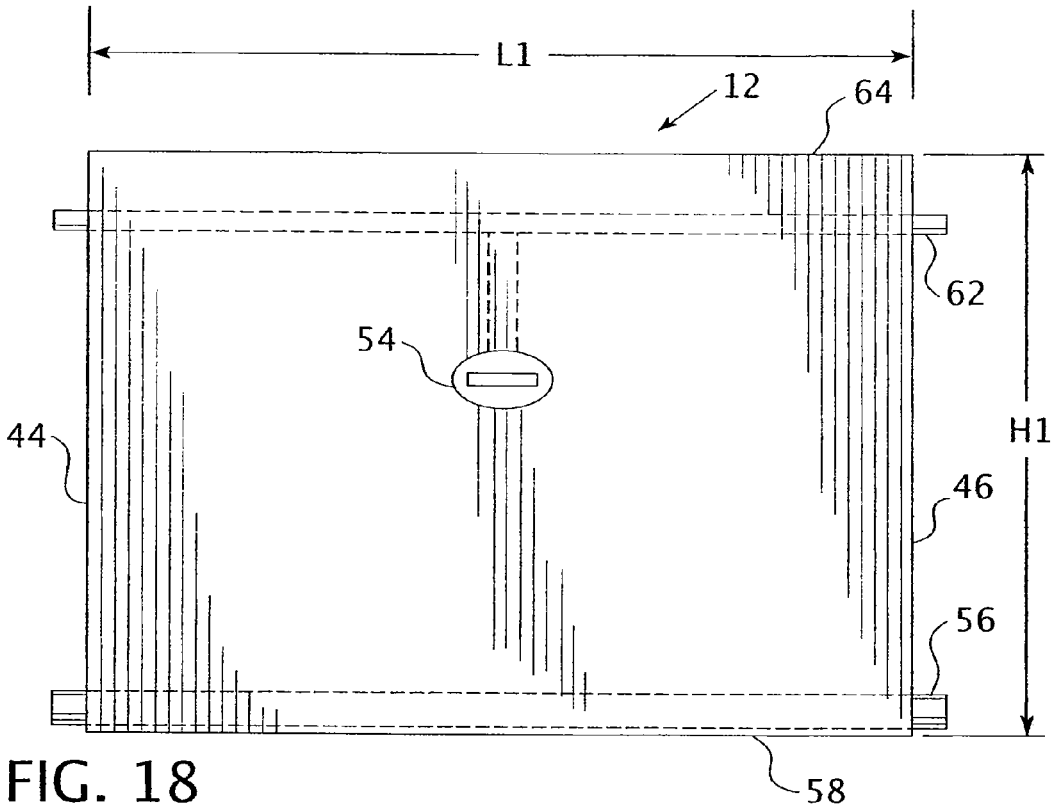
FIG. 18 is a rear elevational view of the movable panel of the building barrier system of FIG. 1 along 18-18.
Figure 18A:
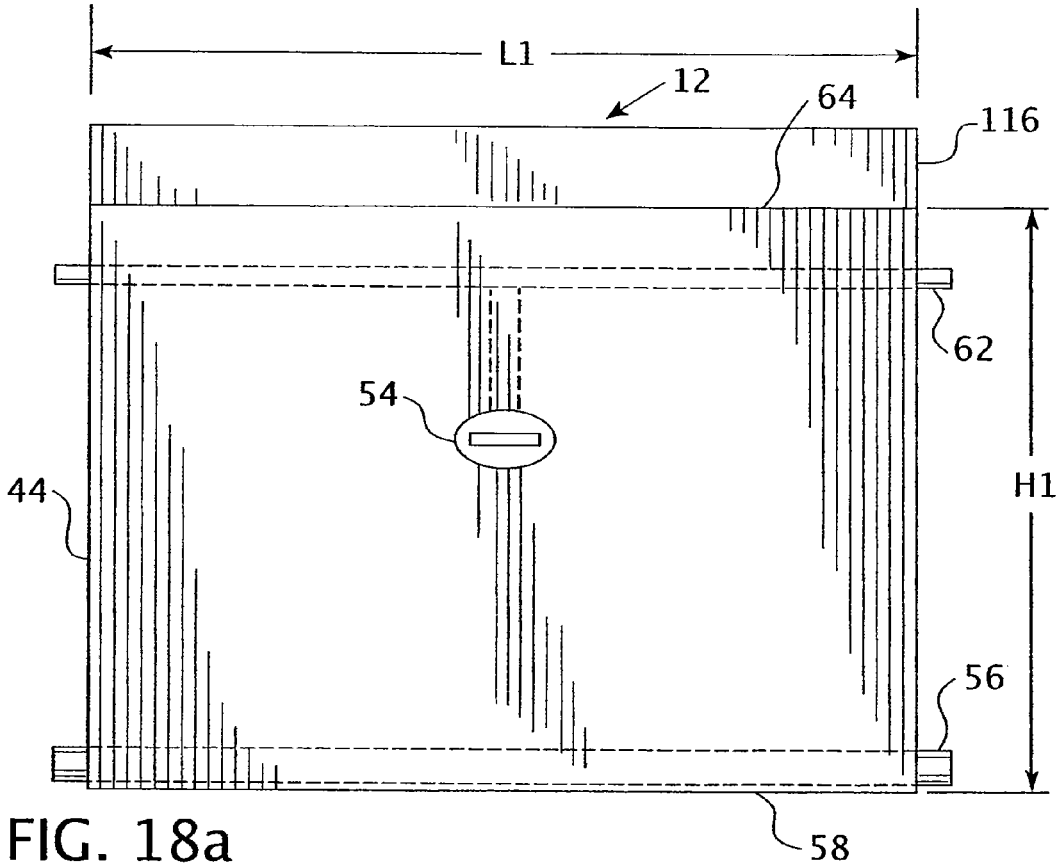
FIG. 18*a* is a rear elevational view of an embodiment of the movable panel of FIG. 18.
Figure 19:
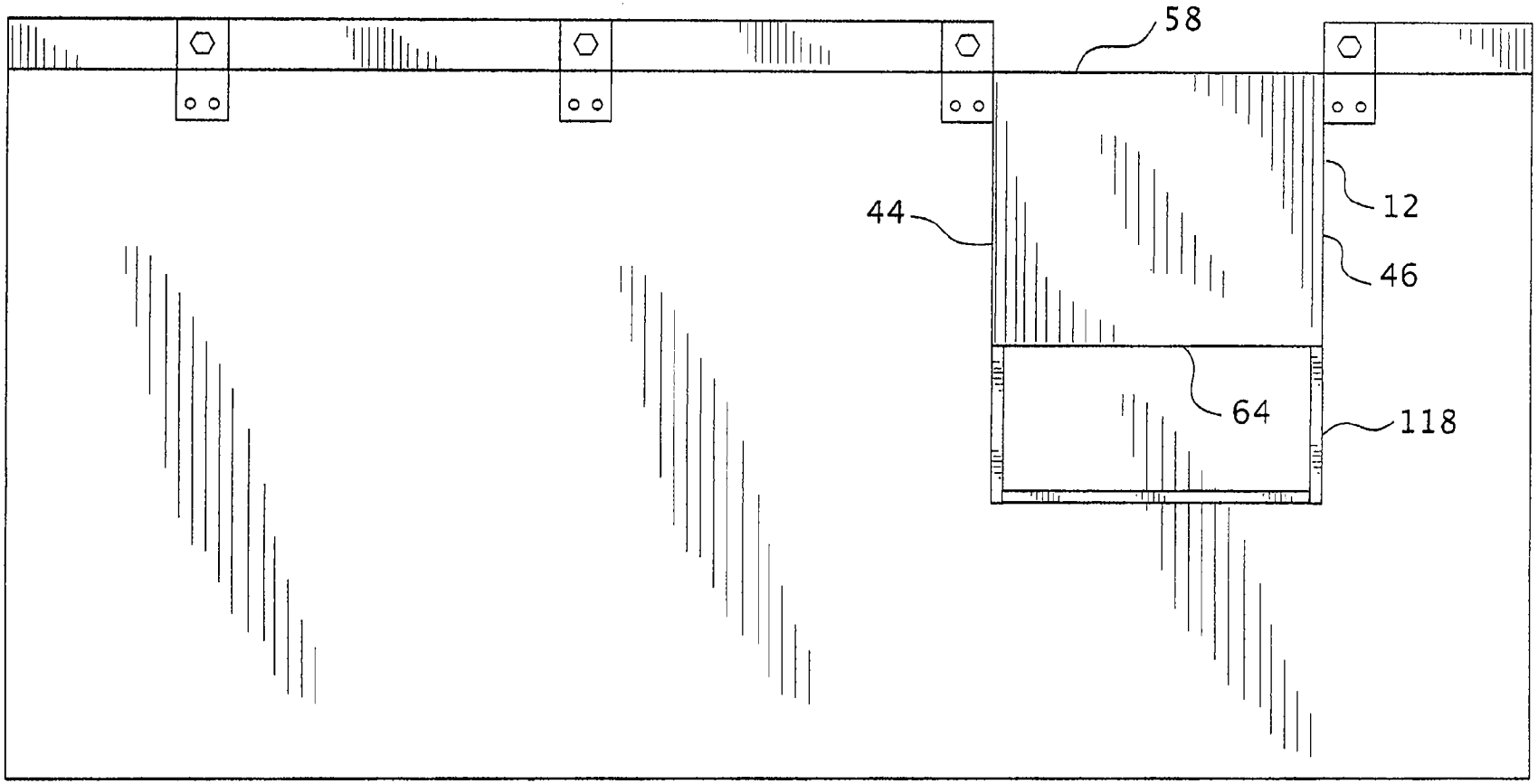
FIG. 19 is a top plan view of another embodiment of the movable panel of FIG. 18.

Referring to FIGS. 17-18*a*, similar to the fixed panel 10, the movable panel 12 is substantially rectangular in shape and has a first edge 44, a second edge 46, a first end 58, and a second end 64. A retractable shaft 62, which is positioned substantially adjacent to the second end 64 of the movable panel 12, secures the movable panel 12 to the adjacent support posts 4 (i.e., second and third support posts 22,48). As stated above, the retractable shaft 62 can be retracted from the adjacent support posts 4 by rotation of the handle 54 (FIGS. 1 and 3), thereby unlocking the movable panel 12 from the adjacent support posts 4. A first shaft 56, which is positioned substantially adjacent to the first end 58 of the movable panel 12, secures the movable panel 12 to the adjacent support posts 4. When the movable panel 12 is unlocked from the adjacent support posts rod 20, the first shaft 56 enables the movable panel 12 to pivot towards the deck 6. Similar to the fixed panel 10, the removable panel 12 also has one or more apertures 112 disposed on the exterior surface 114 of the movable panel 12 that are used to secure a connecting panel 110 to the movable panel 12. The apertures 112 can either be positioned substantially adjacent to the first and second ends 58,64 of the movable panel 12 and/or substantially adjacent to the first and second sides 44,46 of the movable panel 12. In accordance with one embodiment of the invention, the movable panel 12 can have a ramp 116 that is connected to the second end 64 of the movable panel 12 (FIGS. 17*a* and 18*a*). In accordance with another embodiment of the invention, the movable panel 12 has a total height (H) of about 42 inches (in.), a width (W2) of about 2 inches (in.), and a length (L) ranging from about 4 feet (ft.) to about 10 feet (ft.). In accordance with yet another embodiment of the invention, the movable panel 12 can also include a railing system 118 that extends from the second end 64 of the movable panel 12 (see FIG. 19). This railing system 118 can be used as an added safety feature with the aim of preventing an individual from accidentally entering the area where the materials are being imported onto the deck 6.

Figure 20:
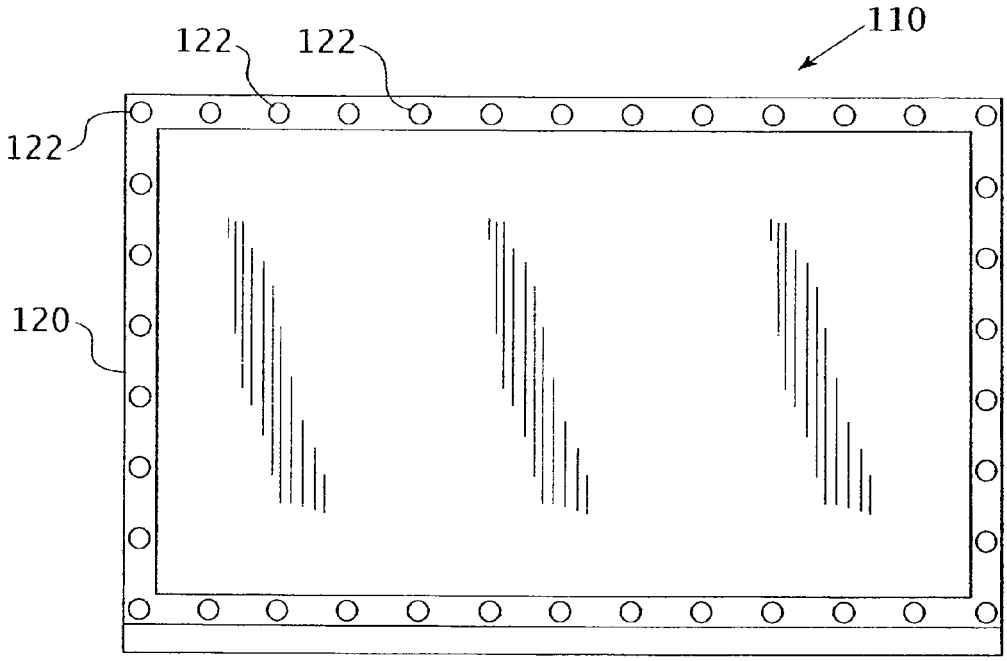
FIG. 20 is a rear elevational view of the connecting panel.
Figure 21A:
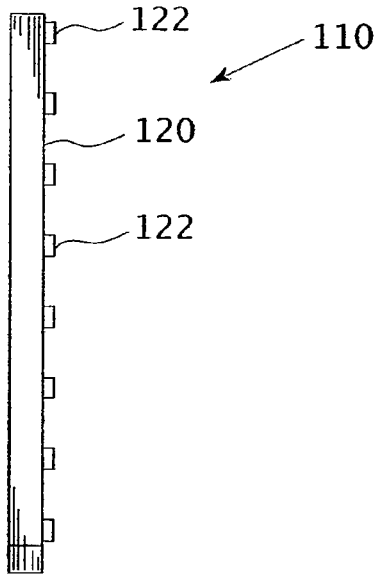
FIG. 21A is a left side elevational view of the connecting panel of FIG. 20.
Figure 21B:
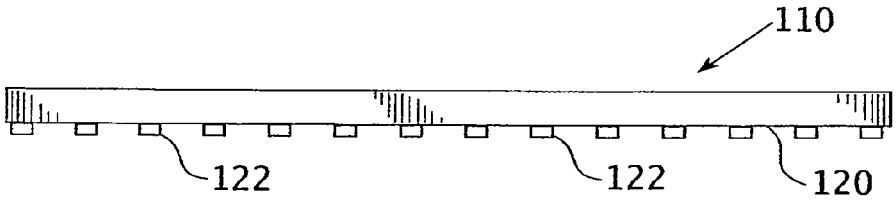
FIG. 21B is a top plan view of the connecting panel of FIG. 20.
Figure 22:
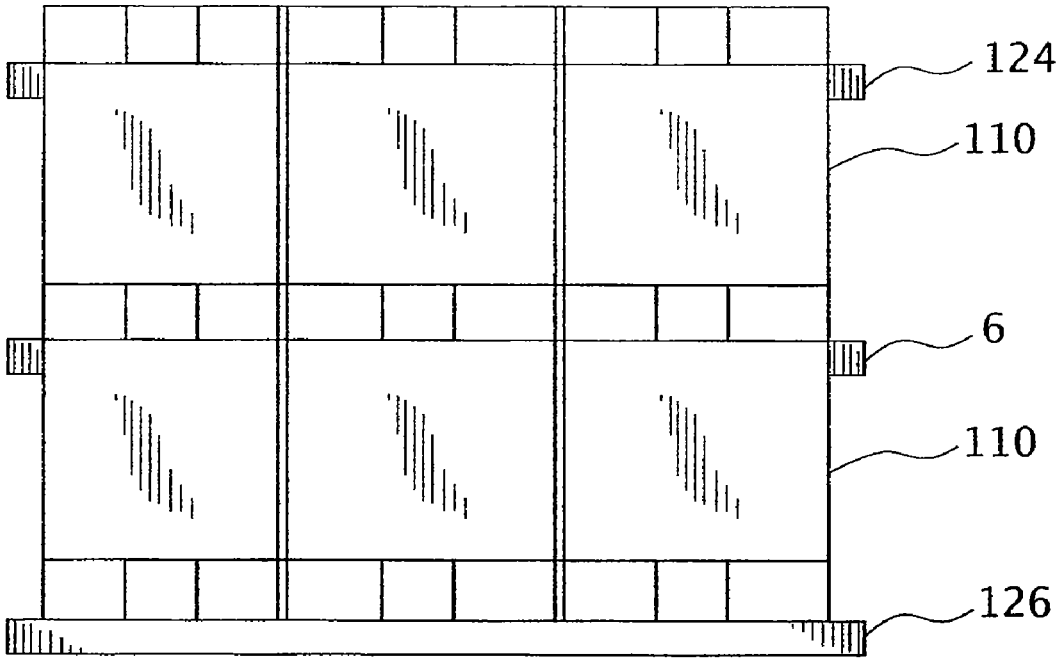
FIG. 22 is a front elevational view of a structure with the building barrier system positioned on adjacent decks and connecting panels connecting the building barrier systems.

Referring to FIGS. 20-21*b*, disposed on and extending from the interior surface 120 of the connecting panel 110 are one or more tabular members 122 that are used to secure the connecting panel 110 to the fixed and/or movable panels 10,12 by mechanically engaging with the apertures 108,112 that are disposed on the fixed and movable panels 10,12. Referring to FIG. 22, the connecting panels 110 are used to completely enclose the structure 8 during construction. As can be seen from this figure, the connecting panel 110 is attached to the fixed or movable panels 10,12 which are located on adjacent decks 124, 126 (i.e. different floors). In one embodiment of the invention, adjacent connecting panels 110 are joined together by utilizing removable strips 128, such as neoprene strips, or by way of mechanical fasteners. In another embodiment of the invention, one end of the connecting panel 110 is secured to either a fixed 10 or movable panel 12 while another end of the connecting panel 110 is secured to an adjacent deck by a mechanical fastener.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A building barrier system for use on a deck of a structure comprising:

a deck;

a first support post having a first side, a second side, a first aperture, and a second aperture;

a second support post having a first side, a second side, a first aperture, and a second aperture;

a third support post having a first side, a second side, a first aperture, and a second aperture;

each of said first, second, and third support posts secured to said deck and extending in a direction substantially perpendicular to said deck, said first support post being substantially parallel and spaced from said second support post and said second support post being substantially parallel to and spaced from said third support post;

a fixed panel having a first edge and a second edge, said first edge of said fixed panel positioned adjacent to said second side of said first support post and said second edge of said fixed panel positioned adjacent to said first side of said second support post, said fixed panel being secured to each of said first and second support post;

a movable panel having a first edge and a second edge, said first edge of said movable panel positioned adjacent to said second side of said second support post and said second edge of said movable panel positioned adjacent to said first side of said third support post, said movable panel in a first position being removably secured to said second and third support posts, and in a second position being pivotable toward said deck;

a first shaft extending from said first and second edges of said movable panel, said first shaft being received into said first aperture disposed in each of said second and third support posts, each of said support post comprises a housing and a threaded rod that extends through said housing in a direction substantially parallel to an axis of said support post, each of said support post further comprises:

a first positioning plate attached to said housing and extending substantially perpendicular to said axis of said support post;

a movable second positioning plate positioned adjacent and parallel to said first positioning plate; and wherein a cavity is defined between said first positioning plate and said movable second positioning plate into which said deck is received.

2. The building barrier system according to claim 1, wherein each of said support post further comprises an end plate that extends substantially perpendicular to said axis of said support post and through which said threaded rod extends, said end plate is positioned substantially adjacent to an end of said threaded rod.

3. The building barrier system according to claim 1, wherein said fixed panel and said moveable panel is made from plastic.

4. The building barrier system according to claim 3, wherein said fixed panel and said movable panel is made from fiberglass.

5. A method of erecting a building barrier system on a deck of a structure, said method comprising:

providing a first support post having a first side, a second side, a first aperture, and a second aperture;

providing a second support post having a first side, a second side, a first aperture and a second aperture;

providing a third support post having a first side, a second side, a first aperture, and a second aperture;

securing each of said first, second, and third support posts to said deck in a direction substantially perpendicular to said deck, said first support post being substantially parallel and spaced from said second support post and said second support post being substantially parallel to and spaced from said third support post;

providing a fixed panel having a first edge and a second edge;

positioning said first edge of said fixed panel adjacent to said second side of said first support post and said second edge of said fixed panel adjacent to said first side of said second support post;

securing said fixed panel to each of said first and second support posts;

providing a movable panel having a first edge and a second edge;

positioning said first edge of said movable panel adjacent to said second side of said second support post and said second edge of said movable panel adjacent to said first side of said third support post;

securing in a first position said movable panel to each of said second and third support posts;

providing a first shaft, said first shaft extending from said first and second edges of said movable panel thereby allowing said movable panel to transition into a second position, wherein said movable panel in said second position being pivotable towards said deck, each of said support post comprises a housing and a threaded rod that extends through said housing in a direction substantially parallel to an axis of said support post, each of said support post further comprises:

a first positioning plate attached to said housing and extending substantially perpendicular to said axis of said support post;

a movable second positioning plate positioned adjacent and parallel to said first positioning plate; and wherein a cavity is defined between said first positioning plate and said movable second positioning plate into which said deck is received.

6. The method according to claim 5, wherein each of said support post further comprises an end plate that extends substantially perpendicular to said axis of said support posts and through which said threaded rod extends, said end plate is positioned substantially adjacent to an end of said threaded rod.

7. The method according to claim 5, further comprising providing a fixed and movable panel made from plastic.

8. The method according to claim 7, further comprising providing a fixed and movable panel made from fiberglass.

9. A building structure comprising:

a deck;

a building barrier system secured to said deck, said building barrier system including:

a first support post having a first side, a second side, a first aperture, and a second aperture;

a second support post having a first side, a second side, a first aperture, and a second aperture;

a third support post having a first side, a second side, a first aperture, and a second aperture;

each of said first, second, and third support posts secured to said deck and extending in a direction substantially perpendicular to said deck, said first support post being substantially parallel and spaced from said second support post and said second support post being substantially parallel and spaced from said third support post;

a fixed panel having a first edge and a second edge, said first edge of said fixed panel positioned adjacent to said second side of said first support post and said second edge of said fixed panel positioned adjacent to said first side of said second support post, said fixed panel being secured to each of said first and second support post;

a movable panel having a first edge and a second edge, said first edge of said movable panel positioned adjacent to said second side of said second support post and said second edge of said movable panel positioned adjacent to said first side of said third support post, said movable panel in a first position being removably secured to said second and third support posts, and in a second position being pivotable toward said deck;

a first shaft extending from said first and second edges of said movable panel, said first shaft being received into said first passageway disposed in each of said second and third support posts, each said support post comprises a housing and a threaded rod that extends through said housing in a direction substantially parallel to an axis of said support post, each of said support post further comprises:

a first positioning plate attached to said housing and extending substantially perpendicular to said axis of said support post;

a movable second positioning plate positioned adjacent and parallel to said first positioning plate; and wherein a cavity is defined between said first positioning plate and said movable second positioning plate into which said deck is received.

10. The building structure according to claim 9, wherein each of said support post further comprises an end plate that extends substantially perpendicular to said axis of said support posts and through which said threaded rod extends, said end plate is positioned substantially adjacent to an end of said threaded rod.

11. The building structure according to claim 9, wherein said fixed panel and said moveable panel is made from plastic.

12. The building structure according to claim 11, wherein said fixed panel and said movable panel is made from fiberglass.

* * * * *

UNITED STATES PATENT AND TRADEMARK OFFICE

CERTIFICATE OF CORRECTION

PATENT NO. : 7,810,285 B1
APPLICATION NO. : 11/851027
DATED : October 12, 2010
INVENTOR(S) : Robert L. Liptak It is certified that error appears in the above-identified patent and that said Letters Patent is hereby corrected as shown below:

Title page, second column, U.S. PATENT DOCUMENTS, "7,258,461 B1 * 08/2007 Izardel et al." should read --Izardel--.
Column 3, line 57, "system of FIG." should read --system of FIG. 1.--.

Signed and Sealed this
Tenth Day of July, 2012

David J. Kappos

David J. Kappos
*Director of the United States Patent and Trademark Office*